US008746824B2

(12) United States Patent
Usuda et al.

(10) Patent No.: US 8,746,824 B2
(45) Date of Patent: Jun. 10, 2014

(54) RECORDING APPARATUS

(75) Inventors: Hidenori Usuda, Matsumoto (JP); Shinichi Kamoshida, Saitama (JP); Takayuki Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 13/430,114

(22) Filed: Mar. 26, 2012

(65) Prior Publication Data

US 2012/0249632 A1 Oct. 4, 2012

(30) Foreign Application Priority Data

Apr. 1, 2011 (JP) ..... 2011-082034
Apr. 19, 2011 (JP) ..... 2011-092773

(51) Int. Cl.
*B41J 29/38* (2006.01)

(52) U.S. Cl.
USPC ..... 347/9; 347/102

(58) Field of Classification Search
USPC ..... 347/5, 9, 17–19, 102; 34/641; 101/488; 219/216
IPC ..... B41J 29/38
See application file for complete search history.

(56) References Cited

U.S. PATENT DOCUMENTS 6,783,227 B2 8/2004 Suzuki et al.
7,393,095 B2 7/2008 Oshima et al.
2004/0100552 A1* 5/2004 Taira et al. ..... 347/236
2004/0119772 A1* 6/2004 Hoshino et al. ..... 347/19
2004/0227801 A1* 11/2004 Kumamoto et al. ..... 347/102
2005/0168509 A1* 8/2005 Yokoyama ..... 347/17
2005/0168555 A1* 8/2005 Niekawa ..... 347/102
2008/0151029 A1* 6/2008 Yokoyama ..... 347/102
2009/0284574 A1* 11/2009 Niekawa ..... 347/102
2010/0309269 A1* 12/2010 Vosahlo et al. ..... 347/102

FOREIGN PATENT DOCUMENTS

JP 2004-314304 11/2004
JP 2005-104108 4/2005

* cited by examiner

*Primary Examiner* — Manish S Shah
*Assistant Examiner* — Roger W Pisha, II
(74) *Attorney, Agent, or Firm* — Workman Nydegger

(57) ABSTRACT

A recording apparatus includes a light irradiation unit including a light emitting element row having therein a plurality of light emitting elements aligned in the same direction as a nozzle row, and a fault detection unit that detects whether there is a fault in each of the light emitting elements. The light emitting elements apply light to a photoreactive liquid discharged onto a recording target material. The light irradiation unit includes a plurality of the light emitting element rows arranged therein. When the fault detection unit detects a fault in a light emitting element, operation enters a fault mode where the light emitting element row to which the faulty light emitting element belongs is turned off and recording is performed with the remaining light emitting element rows.

9 Claims, 11 Drawing Sheets

RECORDING APPARATUS

BACKGROUND

1. Technical Field

The present invention relates to a recording apparatus that includes a recording head having a nozzle row that discharges a photoreactive liquid onto a recording target material, and a light irradiation unit having a light emitting row made up of light emitting elements aligned in the same direction as the nozzle row. The light emitting elements apply light to the discharged photoreactive liquid to cause the photoreactive liquid to undergo a chemical change.

2. Related Art

A recording apparatus including a recording head having nozzle rows in which a large number of nozzle openings for discharging optically-curable ink (e.g., ultraviolet (UV) curable ink) onto a recording target surface of a recording target material (hereinafter also referred to as "paper") are arranged, and a light irradiation unit having a light emitting element row in which a plurality of light emitting elements (e.g., Light Emitting Diodes: LEDs) for applying light to the discharged optically-curable ink to cure the optically-curable ink are arranged has been developed as disclosed in JP-A-2005-104108 and JP-A-2004-314304.

In the case of a recording apparatus of a type in which the recording head is mounted on a carriage that reciprocally moves in a direction crossing the transport direction of paper, optically-curable ink is irradiated with light both when the recording head moves outward and when it moves homeward, and therefore one light emitting element row is arranged on each of right and left sides of nozzle rows of colors, as described in JP-A-2005-104108 and JP-A-2004-314304.

Unfortunately, if a fault occurs in one of the light emitting elements, such as LEDs, constituting the light emitting element rows during a recording operation, optically-curable ink discharged from as many as tens of nozzle openings for which the faulty light emitting element is responsible remain in a state in which all the optically-curable ink is yet to be cured. As a result, a useless printed matter with no commercial value is produced.

In JP-A-2005-104108 and JP-A-2004-314304 mentioned above, no description is given of measures to be taken in such a case where a fault occurs in a light emitting element. Recently, when consideration is given to the market of printed matter produced using optically-curable ink that is widely used, taking measures to counter the problem of a faulty light emitting element has become a challenge of urgent necessity.

That is, it is desirable that a fault be less likely to occur in a light emitting element constituting a light emitting element row, and that if a fault does occur in some of light emitting elements during a recording operation, optically-curable ink be cured to enable continuation of the recording operation.

SUMMARY

An advantage of some aspects of the invention is that it provides a recording apparatus in which a fault is less likely to occur in a light emitting element constituting a light irradiation unit and with which recording can be continued if a fault does occur during recording.

According to an aspect of the invention, a recording apparatus includes a recording head having a nozzle row that discharges a photoreactive liquid onto a recording target material; a light irradiation unit including a light emitting element row having therein a plurality of light emitting elements aligned in a same direction as the nozzle row, the light emitting elements being configured to apply light to the discharged photoreactive liquid to cause the photoreactive liquid to undergo a chemical change; a fault detection unit that detects whether there is a fault in each of the light emitting elements forming together the light emitting element row; and a control unit that controls a recording operation by the recording head and an operation of the light irradiation unit. The light irradiation unit includes a plurality of the light emitting element rows arranged therein. Each of the light emitting element rows includes the light emitting elements connected in series. The control unit is configured to, in a case where the fault detection unit detects a fault in a light emitting element, enter a fault mode where one of the light emitting element rows to which the light emitting element having the fault belongs is turned off and recording is performed with the remaining light emitting element rows.

Here, the "light" as used herein has a broad meaning that typically includes visible light whose short wavelength side ranges from 360 nm to 400 nm and whose long wavelength side ranges from 760 nm to 830 nm, ultraviolet rays whose wavelength is shorter than the visible light and ranges about from 1 nm to 380 nm, and infrared rays whose wavelength is longer than the visible light and ranges about from 780 nm to 1 mm, and further includes, in addition to these rays, electromagnetic waves whose wavelength is shorter than the ultraviolet rays, and electromagnetic waves whose wavelength is longer than the infrared rays. This is adopted for simplification of the description.

Accordingly, the "photoreactive liquid", for simplification of the description, has a meaning including various liquids that react with light in a range of visible light, ultraviolet rays, and infrared rays, which is generally regarded as a range of light, and, in addition to this range, with electromagnetic waves of the short wavelength or the long wavelength, which are outside the range of light, to produce chemical changes.

According to this aspect, the light irradiation unit includes a plurality of the light emitting element rows arranged therein, and each of the light emitting element rows includes the light emitting elements connected in series.

Accordingly, in the case of using all of the plurality of the light emitting element rows that are turned on, the total amount of light irradiation of all the light emitting elements in all the turned-on light emitting element rows needs only to meet the amount required for causing the photoreactive liquid mentioned above to undergo a chemical change. The amount of irradiation emitted from the light emitting elements in one light emitting element row can therefore be set at a lower level than that in the case of the existing one-row structure. This lessens the load involved in light emission of each light emitting element, making it possible to reduce the chance of a fault occurring in the light emitting element.

Moreover, without turning-on of all the plurality of the light emitting element rows, part of the light emitting element rows may be turned on and used.

In this case, the amount of irradiation of each light emitting element is larger than that in the aforementioned case of turning on all the light emitting elements. However, this case enables the amount of irradiation of each light emitting element to be set at a lower level than that in the case of the existing one-row structure, and this case allows usage in which a combination of the light emitting element rows to be turned on is changed for each irradiation. According to this usage, the frequency of use of each light emitting element (the frequency of turning on) is decreased. This also lessens the load involved in light emitting, making it possible to reduce the chance of a fault occurring in the light emitting element.

Further, the control unit is configured to, in the case where the fault detection unit detects a fault in a light emitting element, turn off the light emitting element row to which the faulty light emitting element belongs, and enter the fault mode where recording is performed in the remaining light emitting element rows.

Here, the term "fault mode" means an operational mode for operation at the time of occurrence of a fault. In the case where a fault occurs in a light emitting element, in order to enable continuation of recording without using the light emitting element having the fault, the state of the recording apparatus moves to the "fault mode" from the normal mode where there is no faulty light emitting element. In the "fault mode", priority is given to continuation of recording set beforehand.

Next, the fault can occur in two modes, in the open mode and in the short mode. Each of the light emitting element rows includes a plurality of light emitting elements connected in series. As a result, if a fault occurs in the open mode, all the light emitting elements of that light emitting element row enter a state in which lights are turned off. If a fault occurs in the short mode, the light emitting elements that are not faulty continue to emit light. Therefore, a portion corresponding to the faulty light emitting element has a less amount of light irradiation than other portions. This is likely to cause unevenness.

According to this aspect, if a fault occurs in any mode, the light emitting element row having the fault is turned off. The aforementioned unevenness problem does not arise, and recording can be continued with the remaining light emitting element rows.

Note that, in the case where a fault occurs in the open mode, a light emitting element row having the fault immediately enters a state in which all lights are turned off, and therefore an operation for turning off the light emitting element row is not necessary. Herein, from a viewpoint of avoiding redundancy of the description, the wording "turn off a light emitting element row to which the faulty light emitting element belongs" is also used for the case where a faulty occurs in the open mode.

In the fault mode, a light emitting element row to which a faulty light emitting element belongs is turned off, and recording is performed in the remaining light emitting element rows. However, in the case where an excessive number of light emitting element rows are provided, recording can be performed by, instead of the turned-off light emitting element row mentioned above, turning on another light emitting element row that has not been used.

Also, in the case where all the light emitting element rows are being used, recording can be performed by increasing the amount of irradiation of each of the light emitting element rows in order to make up for the amount of light irradiation of the turned-off light emitting element row.

Also, recording can be performed by controlling an operation in order to reduce the recording speed to lengthen a time period for which the discharged photoreactive liquid is irradiated with light.

Thus, it is possible to continue recording if a fault occurs in part of the light emitting elements.

Note that, in the case where, when all the light emitting elements of the light emitting element row to which the faulty light emitting element belongs are turned off, the total amount of light irradiation of the remaining light emitting element rows does not suffice for recording of the minimum acceptable quality, or in the case where a user has determined beforehand that recording is not to be performed, control is performed in the fault mode so that recording is not performed and is finished at this point.

In the recording apparatus according to the aspect of the invention, the control unit may be configured to be able to execute control, in a case where the fault detection unit detects a fault in a light emitting element, to determine whether the fault has occurred in an open mode; if the fault has occurred in the open mode, to enter the fault mode where recording is performed with the remaining light emitting element rows, other than the light emitting element row to which the light emitting element having the fault belongs; if the fault has occurred in a short mode, to determine whether recording is possible in a case where the light emitting element row to which the light emitting element having the fault belongs is turned off; if possible, to turn off the light emitting element row to which the light emitting element having the fault belongs is turned off and to enter the fault mode; if not possible, to determine whether continuation of recording using the light emitting element row to which the light emitting element having the fault belongs is chosen; if chosen, to continue recording; and if not chosen, to finish recording.

According to the aspect of the invention, the light emitting element row to which the faulty light emitting element belongs is turned off in its entirety regardless of the fault mode. However, for example, in the case where a fault occurs across a plurality of light emitting element rows, if all the light emitting element rows corresponding to the fault are turned off, it is conceivable that the absolute amount of irradiation becomes insufficient, and, as a result, recording cannot be performed.

In some cases, priority is to be given to completion of recording even if recording quality is slightly reduced. When a fault occurs in the short mode, the light emitting elements that are not faulty continue emitting light. Accordingly, regarding the light emitting element row to which the faulty light emitting element belongs, the use thereof enables recording to be continued and completed if it satisfies the required amount of light irradiation although it results in more or less unevenness in image quality.

In this case, it becomes possible to use the recording apparatus in such a way as to meet a user's request that priority is to be given to completion of recording even if recording quality is slightly reduced.

In the recording apparatus according to the aspect of the invention, the plurality of light emitting element rows may be arranged such that each thereof includes the light emitting elements aligned at a predetermined pitch in the same direction as the direction of the nozzle row, the light emitting elements being arranged at positions disposed in the direction of the nozzle row, the positions being same in all the light emitting element rows.

In this case, in addition to the aforementioned effects, since the light emitting elements of each light emitting element row are arranged such that their positions in the direction of the nozzle row are the same in all the light emitting element rows, the total amount of light irradiation received by the reaction liquid does not change when the combination of the light emitting element rows to be turned on is changed among all the light emitting element rows for every irradiation. Therefore, variations in recording quality can be prevented.

In the recording apparatus according to the aspect of the invention, the plurality of light emitting element rows may be arranged such that each thereof includes the light emitting elements aligned at a first predetermined pitch in the same direction as the direction of the nozzle row, the light emitting elements being arranged at positions disposed in the direction of the nozzle row, the positions being located in such a manner that the light emitting element rows are shifted with respect to each other by a second predetermined pitch.

In this case, for the part having the same configuration as that of the just above case, effects similar to those in the just above case are basically attained.

When an fault occurs in a light emitting element of one light emitting element row, the amount of light irradiation of the light emitting element having the fault can be made up for by those of two light emitting elements that are adjacent to each other in the direction of the nozzle row and that are positioned adjacent to the faulty light emitting element in another light emitting element row next to the faulty light emitting element, and light emitting elements at the corresponding positions in a further light emitting element row that is further next to the aforementioned light emitting element row.

In this case, unlike the just above case, the positions in the direction of the nozzle row of light emitting elements are located in such a manner that the light emitting element rows are shifted with respect to each other by the second predetermined pitch. That is, the positions of the boundaries between two light emitting elements adjacent to each other in the row direction in the light emitting element rows are not the same, unlike the just above case, and are shifted with respect to each other. Accordingly, from a viewpoint of uniformity in the amounts of irradiation of the light applied from light emitting elements to the reaction liquid discharged from each nozzle opening, the influence of the positions of the boundaries is dispersed and is less manifestly exerted, unlike the just above case. Thus, the effect of improving uniformity is attained.

In each of the above cases, a specific example of the photoreactive liquid is ultraviolet-rays (UV) curable ink, and a specific example of the light emitting element is an LED for emitting ultraviolet rays.

In the recording apparatus according to the aspect of the invention, the control unit may be configured to be able to set, as the fault mode, a relative velocity Vt of the recording head and the light irradiation unit with respect to the recording target material during recording to be slower than a relative velocity Vn in a normal mode without occurrence of a fault.

In this case, the relative moving velocity Vt during recording of the recording head is set to be slower than the relative moving velocity Vn in the normal mode where no fault occurs. That is, the time for light irradiation per unit area is increased. As a result, it becomes possible to make up for a decrease in the total amount of light irradiation.

In the recording apparatus according to the aspect of the invention, in the just above case, the recording head may be mounted on a carriage carrying out reciprocal movement in a direction crossing a transport direction of the recording target material, the light irradiation unit may be mounted on the carriage and is disposed on each of a front side and a back side in a moving direction of the recording head, and the control unit may be configured to, in the case where the fault detection unit detects a fault in a light emitting element, set the relative velocity Vt to be slower than the relative velocity Vn in both an outward direction and a homeward direction in the reciprocal movement.

In this case, the control unit is configured to, in the case where the fault detection unit detects a fault in a light emitting element, set the relative moving velocity Vt to be slower than the velocity Vn in the state where no fault occurs both in the outward direction and in the homeward direction of the reciprocal movement of the recording head 15 and the light irradiation unit 19. Accordingly, since the velocity of moving outward (outward direction) and the velocity of moving homeward (homeward direction) are equal, the recording conditions from a viewpoint of velocity in a reciprocal operation are equal. Therefore, the quality in reciprocal recording can be made to be even.

Note that, in this case, if the light irradiation unit to which the faulty light emitting element belongs is used only in one direction in the reciprocal movement, there is no faulty light emitting element during movement in the other direction. Therefore, decreasing the moving velocity causes a tendency of the amount of light irradiation to be slightly excessive. To address this, if there is no fault in a light emitting element, any of the light emitting element rows may be set to be in an off-state so that the amounts of light irradiation are the same in both directions of the reciprocal movement of the recording head.

In the recording apparatus according to the aspect of the invention, in the above case, the recording head may be mounted on a carriage carrying out reciprocal movement in a direction crossing a transport direction of the recording target material, the light irradiation unit may be mounted on the carriage and is disposed on each of a front side and a back side in a moving direction of the recording head, and the control unit may be configured to, in the case where the fault detection unit detects a fault in a light emitting element, set the relative velocity Vt to be slower than the relative velocity Vn only in a moving direction in which the light irradiation unit on a side to which the light emitting element having the fault belongs applies light.

In this case, the control unit is configured to set the relative moving velocity Vt to be slower than the velocity Vn only in a moving direction in which the light irradiation unit on a side to which the light emitting element having the fault belongs applies light, and therefore the decrease in throughput of recording can be reduced by half.

The moving velocity differs between outward movement and homeward movement. However, regarding the total amounts of light irradiation in the outward movement and the homeward movement, if a comparison is made between them with a consideration given to the time for light irradiation per unit area based on a difference in velocity, the difference between both directions (the difference between the total amounts of light irradiation) becomes small. Accordingly, the recording conditions from a viewpoint of the total amount of light irradiation in a reciprocal operation become close, and therefore the quality in reciprocal recording can be made to be uniform.

In the recording apparatus according to the aspect of the invention, the control unit may be configured to set the relative velocity Vt to decrease in accordance with the number of light emitting element rows to which light emitting elements having a fault belong.

In this case, the relative moving velocity at the time of occurrence of a fault can be set more appropriately.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
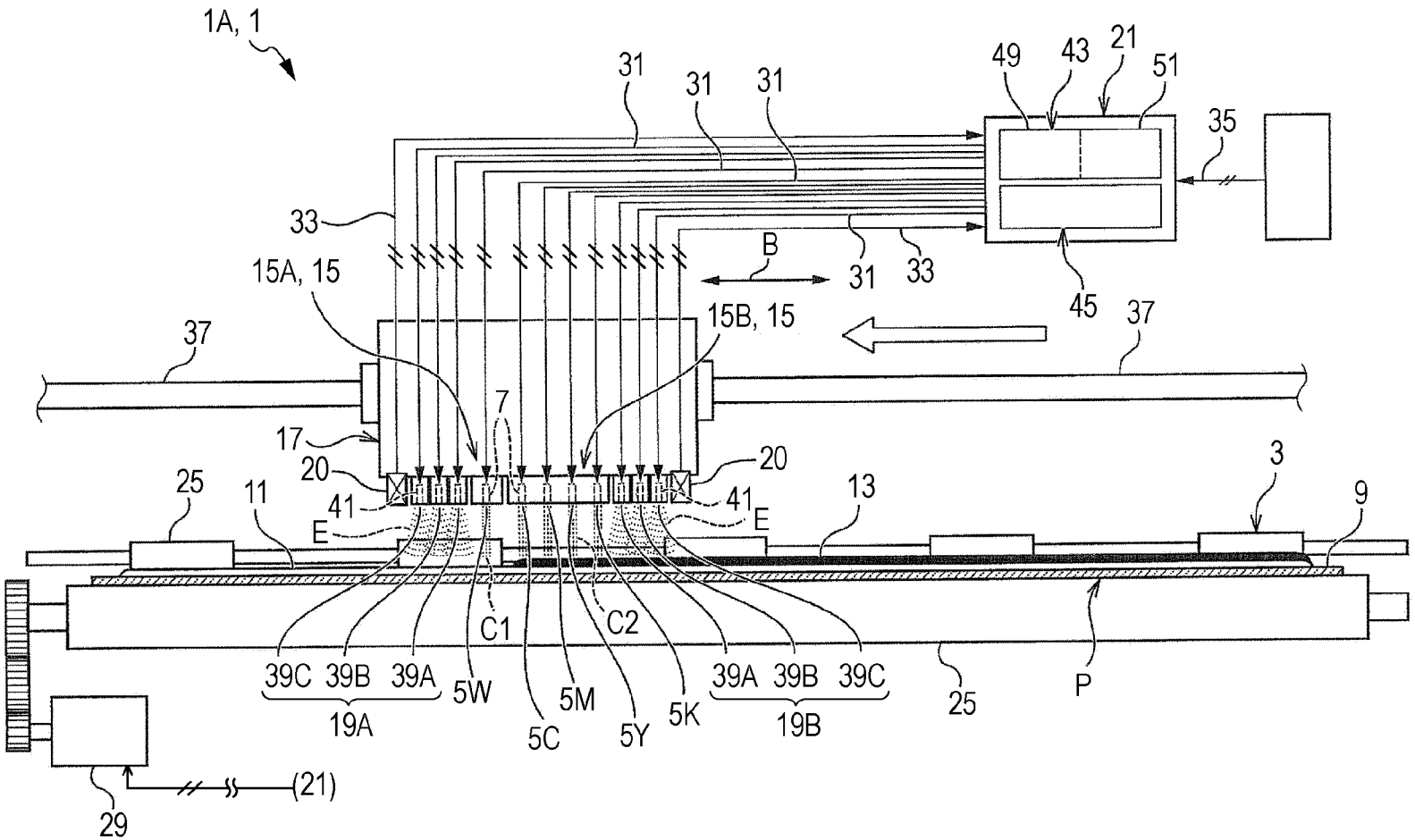
FIG. 1 is a front view illustrating a schematic configuration of the main part of the internal structure of a recording apparatus according to a first embodiment of the invention.

The configuration of a recording apparatus 1 of the invention and operation of the recording apparatus 1 will be described in detail below, as a first embodiment illustrated in FIGS. 1 to 5 and FIGS. 7 to 9 and a second embodiment illustrated in FIGS. 6A to 6C.

It is to be noted that, in the following description, first, the basic configuration of the recording apparatus 1 is described with reference to FIG. 1 and FIG. 2, and then the characteristic configuration of the invention will be described in turn in accordance with the first and second embodiments.

First Embodiment

FIGS. 1 to 5, FIGS. 7 to 9

The recording apparatus 1 illustrated in the figures is an ink jet printer 1 (denoted by the same numeral as the "recording apparatus") capable of performing band feed printing. The ink jet printer 1 includes a transport section 3 that can intermittently transport paper P in a transport direction A by a predetermined band feeding amount D, and nozzle rows 5 each having a plurality of nozzle openings 7 aligned in the same direction as the transport direction A. A plurality of the nozzle rows 5 are arranged in a direction B crossing the transport direction A. Further, the recording apparatus 1 includes a recording head 15 that forms a desired undercoat 11 or image 13 on a recording surface 9 of the paper P with UV curable ink C, as an example of the photoreactive liquid that is discharged from the plurality of nozzle openings 7 together forming the nozzle rows 5.

Note that the term "band" as used herein means a region where recording is performed (recording region) or a region where recording has been performed, the region having a width in the transport direction A corresponding to the nozzle row length of each of the nozzle rows 5 aligned in the transport direction A of a recording target material P.

The term "band feeding amount" as used herein means a feeding amount by which the recording target material P is actually transported when recording is performed on a band-by-band basis.

The ink jet printer 1 includes a carriage 17 that reciprocally moves in the crossing direction B with the recording head 15 mounted thereon, and light irradiation units 19 mounted on the carriage 17 on both sides in the crossing direction B of the recording head 15 in such a manner that the light irradiation units 19 and the recording head 15 are arranged side by side. The light irradiation units 19 are made up of light emitting element rows 39 each formed of a plurality of light emitting diodes (hereinafter also referred to as "LEDs") 41, as one example of light emitting elements that apply ultraviolet rays (UV light) E, as one example of light, to UV curable ink C discharged from the nozzle openings 7 to cause the UV curable ink C to undergo a chemical change (e.g., curing).

A plurality of the light emitting element rows 39 are arranged in the direction B crossing the transport direction A of the paper P. The details of this point are to be described below.

Ultraviolet rays (UV light) E applied from a single LED 41 included in the light emitting element row 39 are used to cure a plurality of pieces of the UV curable ink C discharged respectively from the plurality of nozzle openings 7 together forming the nozzle row 5.

In this embodiment, the ink jet printer 1 is configured such that the UV curable ink C discharged from about thirty-six nozzle openings 7 is cured at once by ultraviolet rays (UV light) E applied from a single LED 41.

Figure 2:
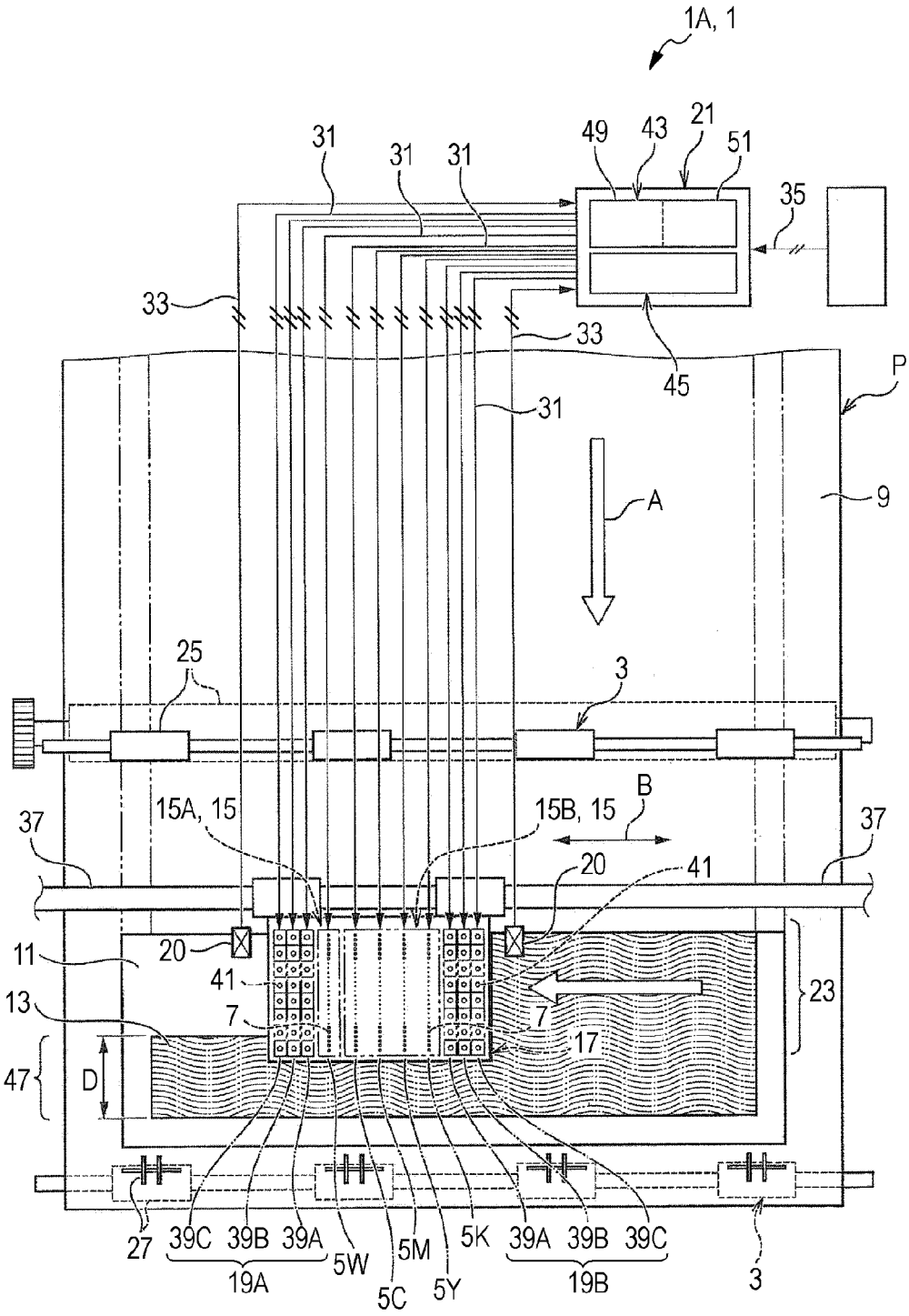
FIG. 2 is a plan view illustrating a schematic configuration of the internal structure of the recording apparatus according to the first embodiment of the invention.

As illustrated in FIG. 1 and FIG. 2, the transport section 3, as one example, includes transport rollers 25 made up of a pair of nip rollers and disposed upstream of a recording region 23, and ejection rollers 27 made up of a pair of nip rollers in the same manner as the transport rollers 25 and disposed downstream of the recording region 23.

Signals 31 for giving an instruction for transportation of the band feeding amount D are sent from a control unit 21 to be described below to a motor 29 that drives the transport rollers 25 and the ejection rollers 27, so that the paper P is intermittently fed by the band feeding amount D.

Regarding the recording head 15, two types of recording heads, a first recording head 15A for discharging undercoat ink C1 and a second recording head 15B for discharging image formation ink C2, are provided in this embodiment. As one example, the first recording head 15A is disposed on the left in FIG. 1 and FIG. 2, and the second recording head 15B is disposed on the right in FIG. 1 and FIG. 2.

Of these recording heads, a nozzle row 5W that discharges the undercoat ink C1 of white (W), gold (G), or silver (S), for example, is provided in the first recording head 15A. In the second recording head 15B, as one example, four nozzle rows 5C, 5M, 5Y, and 5K that individually discharge the image formation ink C2 of four colors, cyan (C), magenta (M), yellow (Y), and black (K), are arranged side by side at predetermined intervals in the crossing direction B.

The signals 31 that give instructions for ink discharge amounts suitable for the positions of the nozzle openings 7 are sent from the control unit 21 to each of the nozzle rows 5W, 5C, 5M, 5Y, and 5K to adjust the ink discharge amounts.

In the illustrated ink jet printer 1, the ink C discharged from the nozzle openings 7 of the nozzle rows 5W, 5C, 5M, 5Y, and 5K is the UV curable ink C, which is cured when irradiated with the ultraviolet rays (UV light) E as mentioned above.

The "UV ink" is ink that is cured and fixed when irradiated with the ultraviolet rays (UV light) E and is excellent in terms of the quick-drying capability. The "UV ink" has a feature in that the volume contraction percentage after being cured is markedly smaller than that for existing pigmented inks that are cured and fixed when a solvent is evaporated by heating using a heater.

The "UV ink" contains no solvent component and is therefore environment-friendly, and is cured instantaneously when irradiated with the UV light (ultraviolet rays) E and therefore is suitable for the recording target material P of a film system with low absorption of ink.

The carriage 17 is a reciprocal transport unit for the recording head 15 that reciprocally moves in the crossing direction B along a carriage guide shaft 37 extending in the crossing direction B.

The power for reciprocal movement of the carriage 17 is received from a motor (not illustrated) that can rotate forward and backward and that can perform precise feed control for every unit step, and rotations of the motor are transmitted to the carriage 17 via a synchronous belt (not illustrated).

Regarding the light irradiation units 19, two types, a first light irradiation unit 19A and a second light irradiation unit 19B are provided. The first light irradiation unit 19A is arranged at the left side, as one example, in FIG. 1 and FIG. 2 of the first recording head 15A for curing the undercoat ink C1. The second light irradiation unit 19B is arranged at the right side, as one example, in FIG. 1 and FIG. 2 of the second recording head 15B for curing image formation ink C2.

In the illustrated ink jet printer 1, the two types of light irradiation units 19A and 19B apply the ultraviolet rays (UV light) E of a predetermined amount of irradiation to the UV curable ink C discharged onto the recording surface 9 of the paper P, thus curing and fixing the UV curable ink C.

The two types of light irradiation units 19A and 19B are each made up of three light emitting element rows 39A, 39B, and 39C in this embodiment. The light emitting element rows 39A, 39B, and 39C are each provided with a plurality of LEDs 41 in an arrangement corresponding to that of the nozzle openings 7 of the nozzle row 5W and the nozzle rows 5C, 5M, 5Y, and 5K in each of the two types of recording heads 15A and 15B.

The signals 31 that provide an instruction regarding the amount of the ultraviolet rays (UV light) E to be applied in correspondence with the position of each LED 41 and an instruction as to whether the ultraviolet rays (UV light) E are to be applied or not are sent from the control unit 21 to each LED 41 so that the amount of irradiation of the ultraviolet rays (UV light) E is adjusted and switching between the presence and absence of irradiation is performed.

An ink jet printer 1A according to the first embodiment includes, in addition to the basic configuration, a fault detection unit 20 that detects whether there is a fault in each of the LEDs 41 together forming the light emitting element rows 39A, 39B, and 39C, and the control unit 21 that causes operations of the two types of recording heads 15A and 15B and operations of the two types of light irradiation units 19A and 19B to switch between a normal mode 43 and a fault mode 45 on the basis of fault detection information 33 from the fault detection unit 20 and setting information 35 set beforehand to enable recording.

As one example of the fault detection unit 20, a mechanism that detects a temperature change in the LEDs 41 in operation, a voltage change in a checking circuit, and so on and discriminates between the operating state of the LEDs 41 in a normal condition and the operating state of the LEDs 41 in an abnormal condition due to an fault can be adopted.

The control unit 21 switches between the recording heads 15A and 15B and the light irradiation units 19A and 19B as appropriate depending on the moving direction of the carriage 17. The selected recording head 15 and light irradiation unit 19 are operated selectively in the aforementioned two types of modes, the normal mode 43 and the fault mode 45.

Note that the normal mode 43 is designed such that a user can select either an all in-use mode 49 in which all the light emitting element rows 39A, 39B, and 39C in three rows are used or a partially in-use mode 51 in which part of the light emitting element rows 39A, 39B, and 39C in three rows are used.

Then, in the all in-use mode 49, the light irradiation unit to be used is switched between the two types of the light irradiation units 19A and 19B depending on whether the carriage 17 moves outward or homeward, and, during the use of the light irradiation unit 19A or 19B, all the LEDs 41 included in the light emitting element rows 39A, 39B, and 39C in three rows are turned on, so that the ultraviolet rays (UV light) E are emitted.

In the partially in-use mode 51, the light irradiation unit to be used is switched between the two types of the light irradiation units 19A and 19B depending on whether the carriage 17 moves outward or homeward, and, during the use of the light irradiation unit 19A or 19B, one or two light emitting element rows are selected from the three light emitting element rows 39A, 39B, and 39C. Further, the light emitting element row to be selected (in the case of two light emitting element rows to be selected, a combination thereof) is changed among the light emitting element rows 39A, 39B, and 39C for each irradiation, and the LEDs 41 of only the selected light emitting element row 39 are turned on, so that the ultraviolet rays (UV light) E are emitted, while the LEDs 41 of other light emitting element rows 39 are turned off.

Note that, at the time of selecting one or two light emitting element rows 39 to be used, the one or two light emitting element rows 39 to be used may be selected in turn regularly from all the light emitting element rows 39 on the basis of the number of times emission of light has been performed and light emission period at this point in time, or may be selected at random.

In the fault mode 45, it is possible to stop using the light emitting element row 39 in which a fault in an LED 41 has been detected, and to change the row to be used to another light emitting element row 39 in which a fault in an LED 41 has not occurred.

Figure 3:
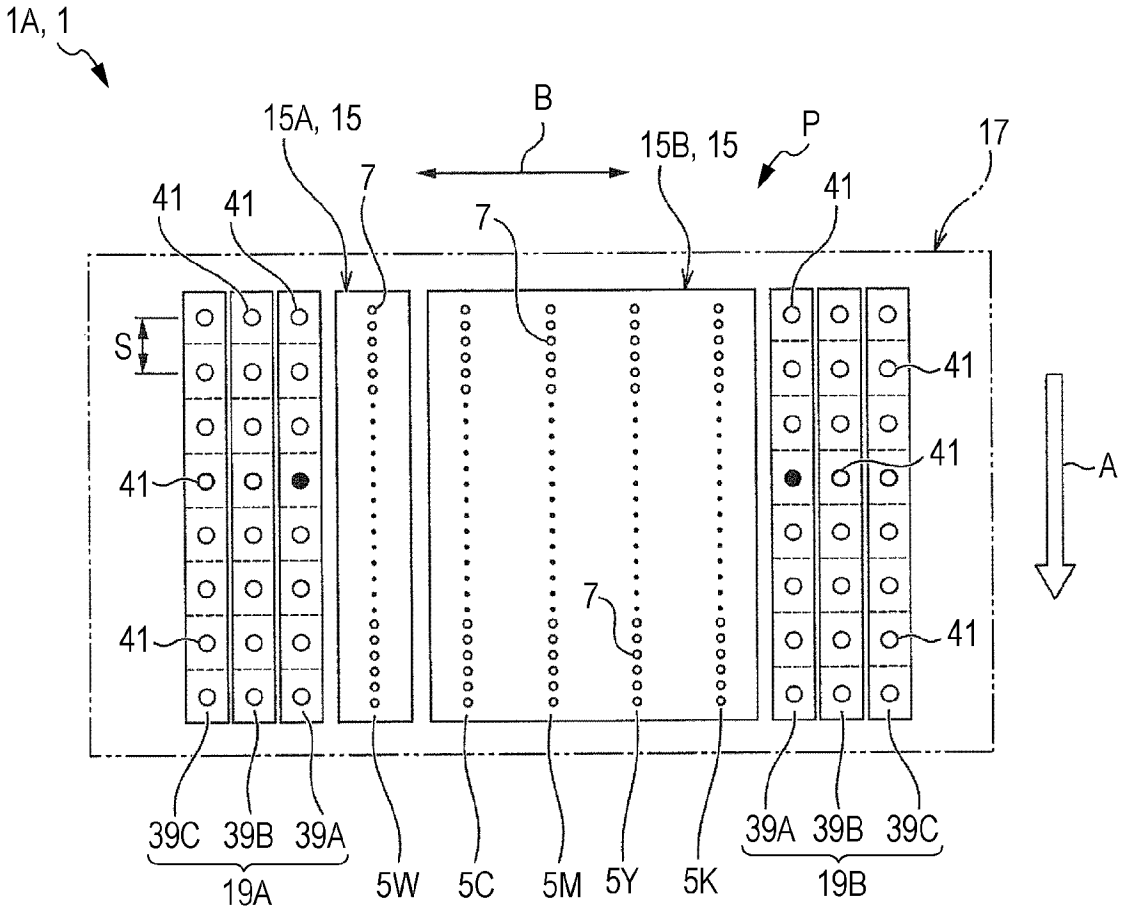
FIG. 3 is an enlarged schematic view of a light emitting element row of the recording apparatus according to the first embodiment of the invention.

In this embodiment, as illustrated in FIG. 3, the light emitting element rows 39A, 39B, and 39C in three rows are arranged in the following manner. Each of the light emitting element rows 39A, 39B, and 39C includes the LEDs aligned at a predetermined pitch S in the transport direction A of the paper P. The LEDs 41 of each light emitting element row 39 are arranged at positions disposed in the transport direction A of the paper P. The positions are the same in all the light emitting element rows 39A, 39B, and 39C.

Accordingly, when a fault occurs in an LED 41 of one light emitting element row 39, the LED 41 of another light emitting element row 39 at the same position in the transport direction A as that of the faulty LED 41 acts so as to make up for a shortage of the amount of irradiation of the faulty LED 41.

In connection with this, one or two LEDs 41 of other light emitting element rows 39 at the same position as that of the faulty LED 41 in the transport direction A take charge of all the shortage of the amount of irradiation of the faulty LED 41 to make up for the shortage, thereby allowing the UV curable ink C to be desirably cured.

Next, in accordance with flowcharts illustrated in FIG. 4 and FIG. 5, the flow of operation of the ink jet printer 1A according to this embodiment will be described in detail in such a manner that the operation is divided into an operation (1) when running in a normal mode and an operation (2) when running in a fault mode.

(1) When Running in Normal Mode: FIG. 4

Figure 4:
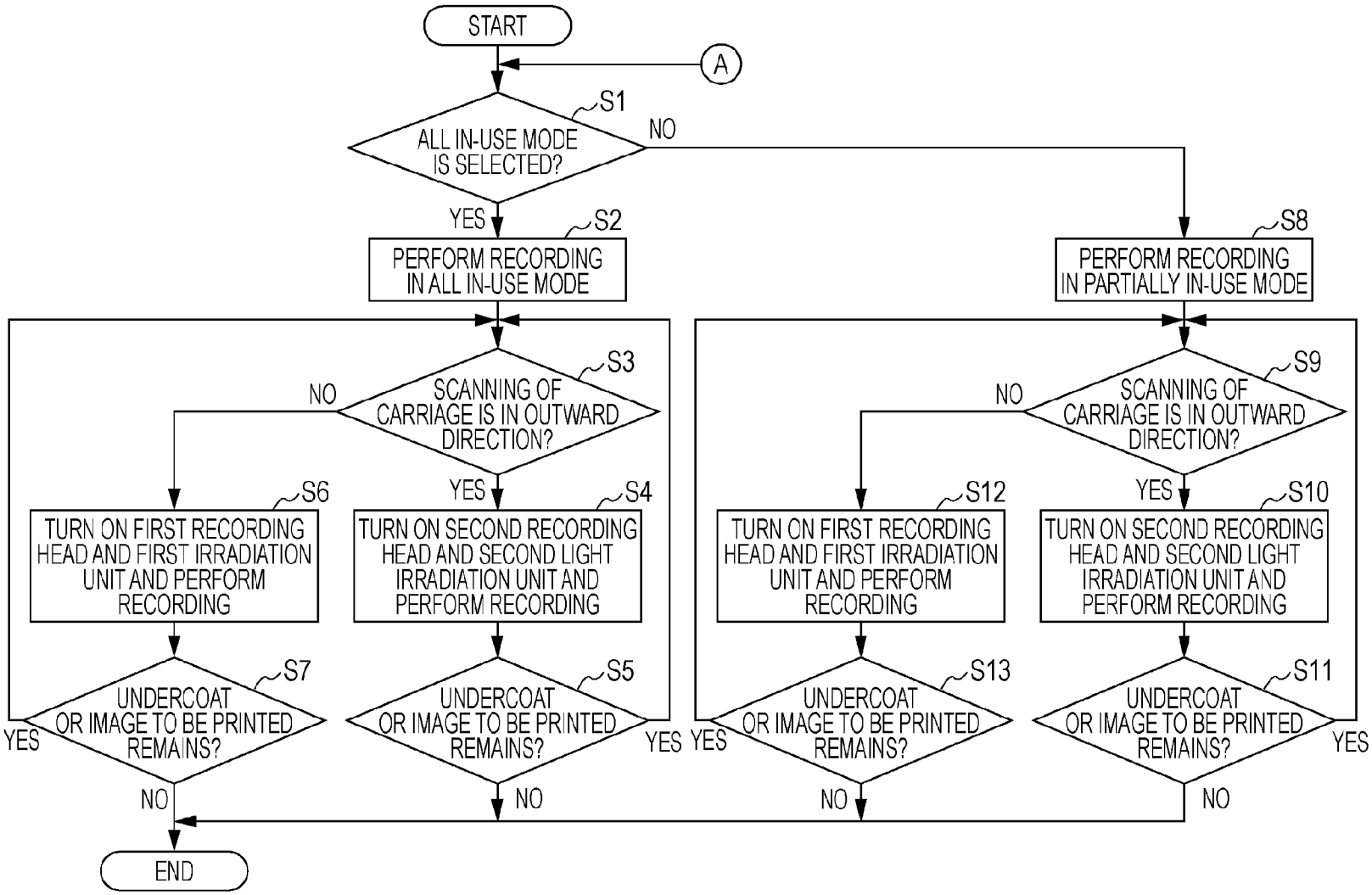
FIG. 4 is a flowchart illustrating a flow of operation when running in the normal mode of the recording apparatus according to the first embodiment of the invention.
Figure 5:
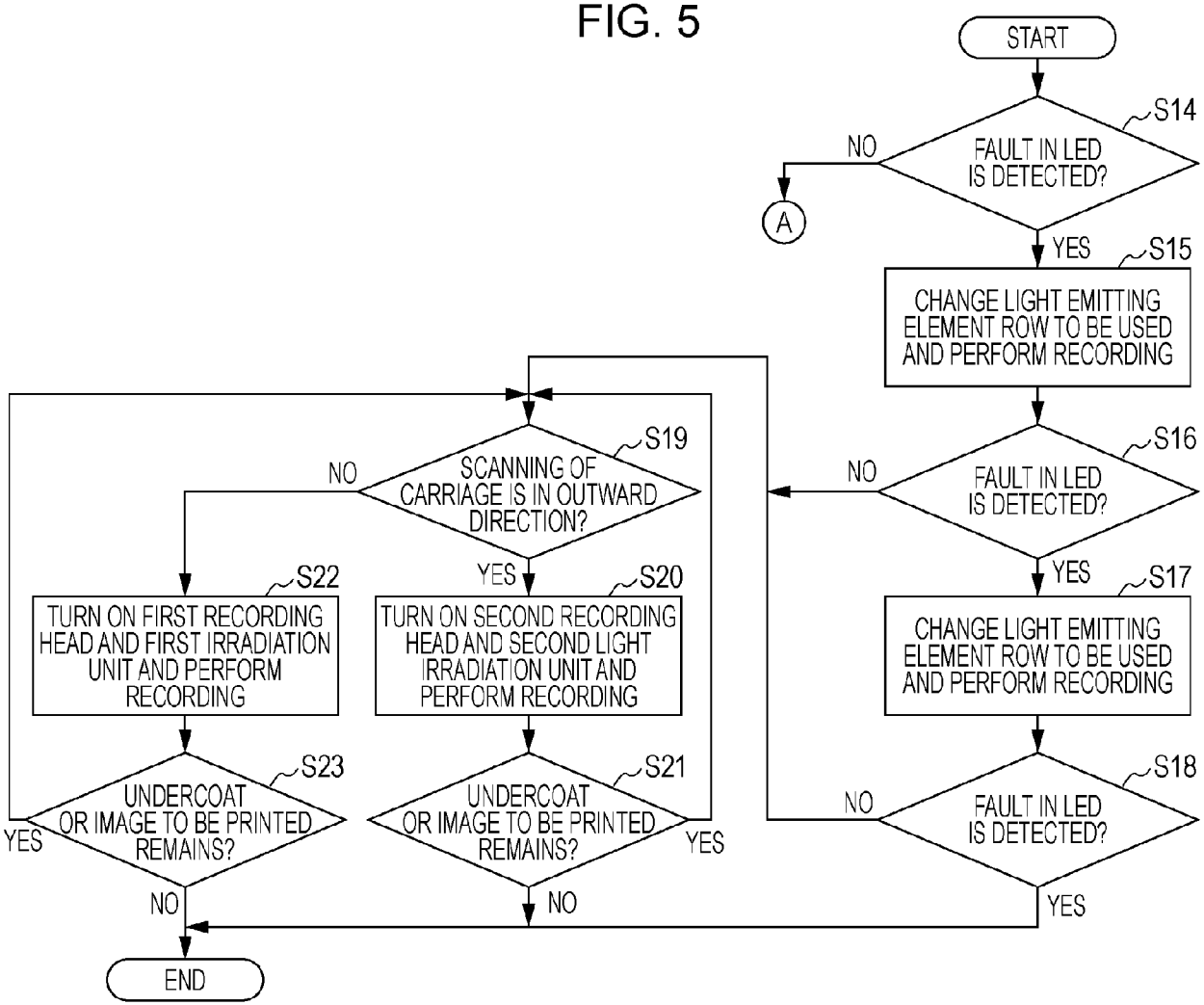
FIG. 5 is a flowchart illustrating a general flow of the entire operation when running in the fault mode of the recording apparatus according to the first embodiment of the invention.

In this embodiment, when a fault in the LED 41 has not occurred, an operation in the normal mode 43 illustrated in FIG. 4 is performed in the control unit 21. In step S1, it is determined whether the all in-use mode 49 is selected or the partially in-use mode 51 is selected. If the all in-use mode 49 is selected, then the process moves to step S2, in which recording is performed in the aforementioned all in-use mode 49.

In the all in-use mode 49, the total amount of light irradiation of all the elements in all the light emitting element rows 39A, 39B, and 39C when the elements are turned on needs only to meet the amount required for causing the aforementioned photoreactive liquid to undergo a chemical change. The amount of irradiation emitted from the light emitting elements in one light emitting element row can therefore be set at a lower level than that in the case of the existing one-row structure. This lessens the load involved in light emitting of each LED 41, making it possible to reduce the chance of a fault occurring in the LED 41.

Next, the process proceeds to step S3, in which it is determined whether the carriage 17 is moving in an outward direction or in a homeward direction. If it is determined that the carriage 17 is moving in the outward direction, then the process moves to step S4, in which the second recording head 15B and the second light irradiation unit 19B are turned on, the first recording head 15A and the first light irradiation unit 19A are turned off, and recording is performed.

Next, the process proceeds to step S5, in which it is determined whether a portion of the undercoat 11 or image 13 to be printed remains. If it is determined that no portions of the undercoat 11 or image 13 to be printed remain, then recording is finished.

On the other hand, if, in step S5, it is determined that a portion of the undercoat 11 or image 13 to be printed remains, then the process returns to step S3 to repeat the determination and operations of steps S3 to S5.

If, in step S3, it is determined that the carriage 17 is moving in a homeward direction, then the process moves to step S6, in which the first recording head 15A and the first irradiation unit 19A are turned on, the second recording head 15B and the second light irradiation unit 19B are turned off, and recording is performed.

Next, the process proceeds to step S7, in which it is determined whether a portion of the undercoat 11 or image 13 to be printed remains. If it is determined that no portions of the undercoat 11 or image 13 to be printed remain, then recording is finished.

On the other hand, if, in step S7, it is determined that a portion of the undercoat 11 or image 13 to be printed remains, then the process returns to step S3 to repeat the determination and operations of steps S3 to S5.

If, in step S1 mentioned above, the partially in-use mode 51 is selected, then the process moves to step S8, in which recording is performed while the light emitting element row 39 is changed appropriately according to the setting information 35 set beforehand.

In this case, the amount of irradiation of each LED 41 is larger than that in the aforementioned case of turning on all the elements. However, the amount of irradiation of each LED 41 can be set at a lower level than that in the case of the existing one-row structure, and a combination of the light emitting element rows 39 to be turned on are changed for each irradiation among all the three rows. Thus, the frequency of use of each LED 41 (the frequency of turning on each LED 41) is decreased. This also lessens the load involved in light emitting of each LED 41, making it possible to reduce the chance of a fault occurring in the LED 41.

At this point, in this embodiment, since the LEDs 41 of each light emitting element row are arranged such that their positions in the direction of the aforementioned nozzle row 5 are the same in all the light emitting element rows, the total amount of light irradiation received by the reaction liquid does not change when the combination of the light emitting element rows 39 to be turned on is changed among all the three rows for every irradiation. Therefore, variations in recording quality can be prevented.

Thereafter, steps S9 to S13, which are similar to steps S3 to S7 described above, are performed. If, in step S11 or S13, it is determined that no portions of the undercoat 11 or image 13 to be printed remain, then recording is finished.

(2) When Running in Fault Mode: FIG. 5, FIGS. 7 to 9

In step S14, it is determined whether transmission of the fault detection information 33 from the fault detection unit 20 is present or absent. If it is determined that a fault in the LED 41 is detected, then the process moves to step S15, in which a change is made from the light emitting element row 39 including the LED 41 where the fault has been detected to another light emitting element row 39, and recording is performed. The detailed contents of step 15 will be described below with reference to FIGS. 7 to 9.

Next, the process proceeds to step S16, in which it is determined again whether transmission of the fault detection information 33 from the fault detection unit 20 is present or absent.

If, in step S16, it is determined that a fault in an LED 41 is detected, then the process moves to step S17, in which the light emitting element row 39 to be used is changed to the remaining one light emitting element row 39, and recording is performed. The contents of step 17 are basically the same as those of step 15 described above.

Next, the process proceeds to step S18, in which, for the third time, it is determined whether transmission of the fault detection information 33 from the fault detection unit 20 is present or absent. If it is determined that a fault is detected in an LED 41, then a defective item will be produced if recording is performed as it is, and therefore recording is finished.

If, in step S16 and step S18 described above, a fault in an LED 41 is not detected, then the process moves to step S19. Steps S19 to S23, which are similar to steps S3 to S7 in FIG. 4 described above, are performed. If, in step S21 or step S23, it is determined that no portions of the undercoat 11 or image 13 to be printed remain, then recording is finished.

If, in step S14 described above, a fault in an LED 41 is not detected, then the process moves to step S1 in FIG. 4 described above. In step S1, recording in the normal mode is performed.

Details of Operation when Running in Fault Mode

Next, the contents of step 15 described above will be described in detail.

Figure 7:
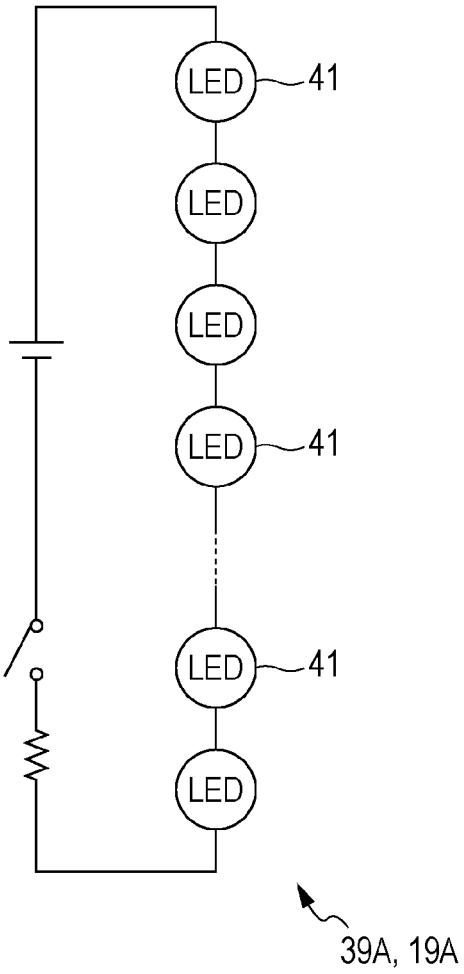
FIG. 7 is a circuit configuration diagram illustrating the connection structure of light emitting elements of the light emitting element row of each of the aforementioned embodiments.

As illustrated in FIG. 7, each of the light emitting element rows 39A, 39B, and 39C mentioned above includes a plurality of light emitting elements 41 connected in series. FIG. 7 illustrates a circuit configuration diagram of the light emitting element row 39A as a representative example. The circuit configuration diagrams of other light emitting element rows 39B and 39C are the same as this.

Then, the control unit 21 is configured to, in the case where the fault detection unit 20 detects a fault in a light emitting element 41, turn off the light emitting element row 39A to which the faulty light emitting element 41 belongs, and enter the fault mode where recording is performed in the remaining light emitting element rows 39B and 39C.

The fault in the light emitting element row 39 occurs in two modes, in the open mode and in the short mode, as described above. The plurality of light emitting elements 41 are connected in series in each light emitting element row 39. As a result, if a fault occurs in the open mode, all the light emitting elements 41 of that light emitting element row 39 enter a state in which lights are turned off. If a fault occurs in the short mode, the light emitting elements 41 that are not faulty continue to emit light. Therefore, a portion corresponding to the faulty light emitting element 41 has a less amount of light irradiation than other portions. This is likely to cause unevenness.

Figure 8:
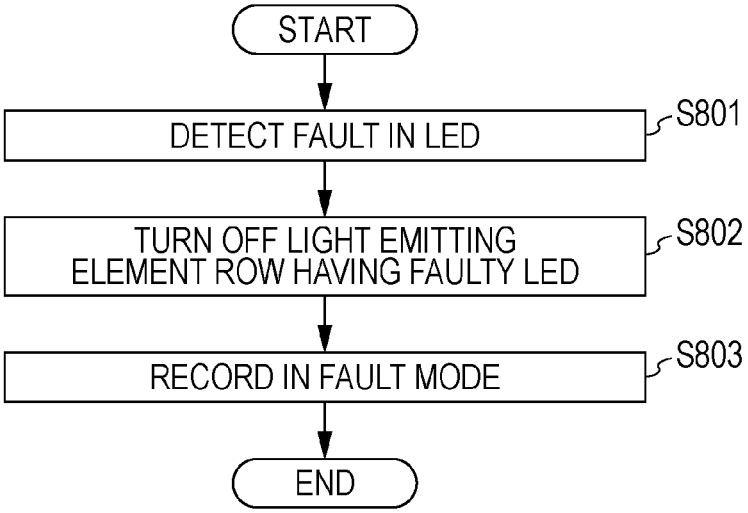
FIG. 8 is a flowchart illustrating the details of operation when running in the fault mode of the recording apparatus according to the first embodiment of the invention.

As illustrated in FIG. 8, according to this embodiment, if a fault occurs in an LED 41 in any mode, the light emitting element row 39A including that LED 41 is turned off (steps S801 to S802), and the fault mode is entered, in which recording is performed (step S803). Accordingly, the aforementioned unevenness problem does not arise, and recording can be continued with the remaining light emitting element rows 39B and 39C.

In the fault mode, the light emitting element row 39A to which the faulty light emitting element 41 belongs is turned off, and recording is performed in the remaining light emitting element rows 39B and 39C. However, in the case where an excessive number of light emitting element rows 39 are provided, recording can be performed by turning on, instead of the turned-off light emitting element row 39A mentioned above, another light emitting element row that has not been used.

Also, in the case where all the light emitting element rows 39 are being used, recording can be performed by increasing the amount of irradiation of each row in order to make up for the amount of light irradiation of the light emitting element row 39A that has been turned off.

Also, as described below, recording can be performed by controlling operation in order to reduce the recording speed to lengthen a time period for which the discharged photoreactive liquid is irradiated with light.

Thus, it is possible to continue recording if a fault occurs in part of the light emitting elements 41.

Note that, in the case where, when all the light emitting elements of the light emitting element row to which the faulty light emitting element belongs are turned off, the total amount of light irradiation of the remaining light emitting element rows does not suffice for recording of the minimum acceptable quality, or in the case where a user has determined beforehand that recording is not to be performed, control is performed in the fault mode that recording is not performed and is finished at this point.

Details 1 of Operation when Running in Another Fault Mode

Figure 9:
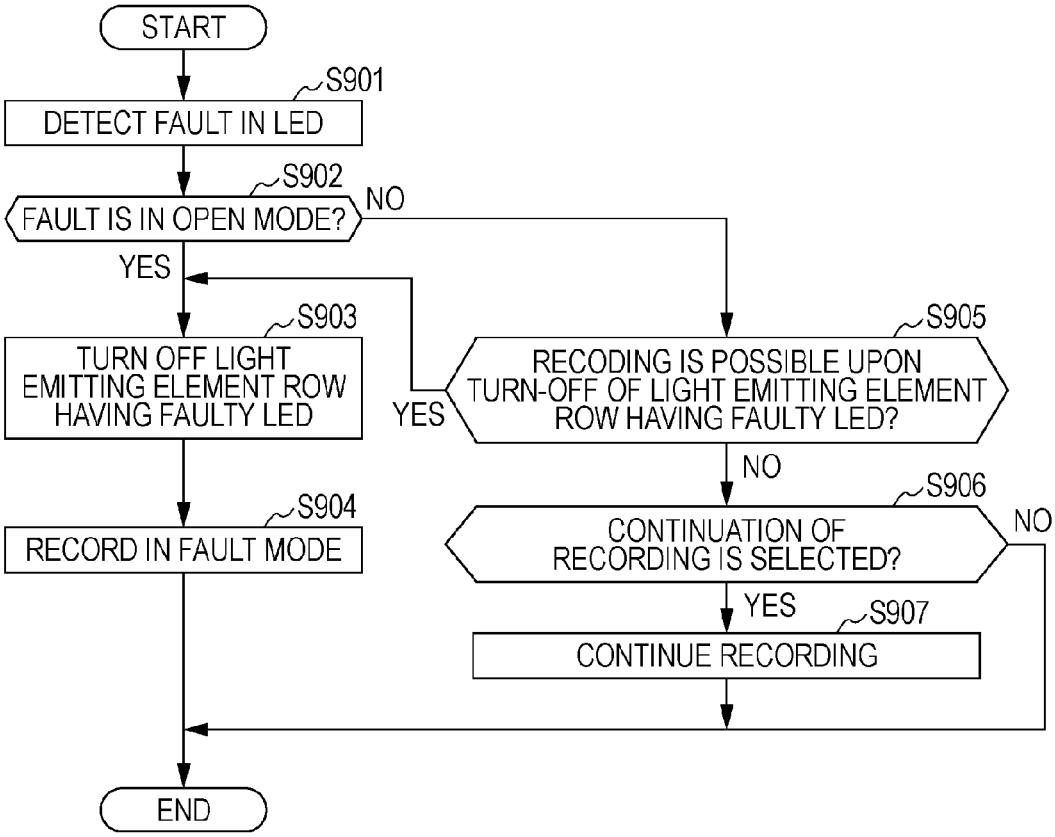
FIG. 9 is a flowchart illustrating the details of operation when running in another fault mode of the recording apparatus according to the first embodiment of the invention.

With reference to FIG. 9, the details 1 of operation when running in another fault mode will be described.

When the fault detection unit 20 detects a fault in a light emitting element 41 (step S901), the control unit 21 determines whether the fault has occurred in the open mode (step S902). If the fault has occurred in the open mode, then the light emitting element row 39A to which the faulty light emitting element 41 belongs is turned off (step S903), and the process enters the fault mode where recording is performed with the remaining light emitting element rows 39B and 39C (step S904).

On the other hand, if the fault has occurred in the short mode, not in the open mode, it is determined whether recoding is possible when the light emitting element row 39A to which the faulty light emitting element 41 belongs is turned off (step S905). If possible, then the light emitting element row to which the faulty light emitting element belongs is turned off (step S903), and the process enters the fault mode (step S904).

If not possible, then it is determined whether continuation of recording using the light emitting element row 39A to which the faulty light emitting element belongs is selected beforehand (step S906). If selected, recording is continued (step S907). If not selected, recording is finished.

In the aforementioned operation when running in the fault mode, the light emitting element row 39A to which the faulty light emitting element 41 belongs is turned off in its entirety regardless of the fault mode. However, for example, in the case where a fault occurs across a plurality of light emitting element rows, if all the light emitting element rows corresponding to the fault are turned off, the absolute amount of irradiation might become insufficient, making it impossible to perform recording.

In some cases, priority is to be given to completion of recording even if recording quality is slightly reduced. When a fault occurs in the short mode, the light emitting elements 41 that are not faulty continue emitting light. Accordingly, regarding the light emitting element row 39A to which the faulty light emitting element 41 belongs, the use thereof enables recording to be continued and completed if it satisfies the required amount of light irradiation although it results in more or less unevenness in image quality.

According to the embodiment illustrated in FIG. 9, it becomes possible to use the recording apparatus in such a way as to meet a user's request that priority is to be given to completion of recording even if recording quality is slightly reduced.

With the ink jet printer 1A according to the first embodiment configured in this way, it is possible to prevent a fault occurring in an LED 41 from leading to generation of an unnecessary printed matter without a commercial value, or from leading to use of a wasteful amount of UV curable ink. In this respect, that ink jet printer 1A has an effect particularly when running unattended.

The UV curable ink C that has not been cured and remains in the main body of the recording apparatus can also be prevented from adhering to a structure member or the like in that main body to reduce the performance of that recording apparatus.

Details 2 of Operation when Running in Another Fault Mode

As the fault mode described above, a relative moving velocity Vt of the recording head 15 and the light irradiation unit 19 with respect to the recording target material P during recording is designed to be set to be slower than a relative moving velocity Vn in the "normal mode" without a fault.

In this embodiment, the relative moving velocities Vt and Vn are each a moving velocity of the carriage 17 with respect to the recording target material P in a stopped state. In the case of a line printer, the relative moving velocities Vt and Vn are each a moving velocity of the recording target material transported with respect to the recording head at the fixed position.

In this embodiment, in the case where the fault detection unit detects a fault of a light emitting element, the relative moving velocity Vt is set to be slower than the velocity Vn in the state where no fault occurs in both in the outward direction and in the homeward direction of the reciprocal movement of the recording head 15 and the light irradiation unit 19. Accordingly, since the velocity of moving outward (outward direction) and the velocity of moving homeward (homeward direction) are equal, the recording conditions from a viewpoint of velocity in a reciprocal operation are equal.

Note that, in this case, if the light irradiation unit 19 (e.g., the light irradiation unit 19A) to which the faulty LED 41 belongs is used only for movement in one direction (e.g., outward) in the reciprocal movement, the light irradiation unit (e.g., 19B) used during movement in the other direction (e.g., homeward) has no faulty LED 41. Therefore, decreasing the moving velocity causes the amount of light irradiation of the light irradiation unit without the faulty LED 41 to tend to be slightly excessive. To address this, if the light irradiation unit (e.g., 19B) has no faulty LED 41, any of the light emitting element rows 39 of that light irradiation unit (e.g., 19B) may be set to be in an off-state so that the amounts of light irradiation are the same in both directions of the reciprocal movement of the light irradiation units 19A and 19B.

Also, the relative moving velocity Vt may be set to be slower than the velocity Vn only in a moving direction in which the light irradiation unit (e.g., the light irradiation unit 19A) to which the faulty LED 41 belongs applies light. With this configuration, the decrease in throughput of recording can be reduced by half.

Also, the configuration may be made such that the relative moving velocity Vt is set to decrease in accordance with the number of rows to which the faulty LEDs 41 belong. With this configuration, the relative moving velocity at the time of occurrence of a fault can be set more appropriately.

As described above, if a fault occurs in one of the LEDs 41 during recording, the process can enter the "fault mode" where recording is performed with the remaining light emitting element rows 39 (e.g., 39A and 39B), other than the light emitting element row 39 (e.g., 39C) to which the faulty LED belongs. Recording can therefore be continued using the remaining light emitting element rows 39 (e.g., 39A and 39B). At this point, the total amount of irradiation of light applied to ultraviolet curing ink decreases. However, the relative moving velocity Vt during recording of the recording head 15 is set to be slower than the relative moving velocity Vn in the "normal mode" where no fault occurs. That is, the time for light irradiation per unit area is increased. As a result, it becomes possible to make up for a decrease in the total amount of light irradiation.

Second Embodiment

Figure 6A:
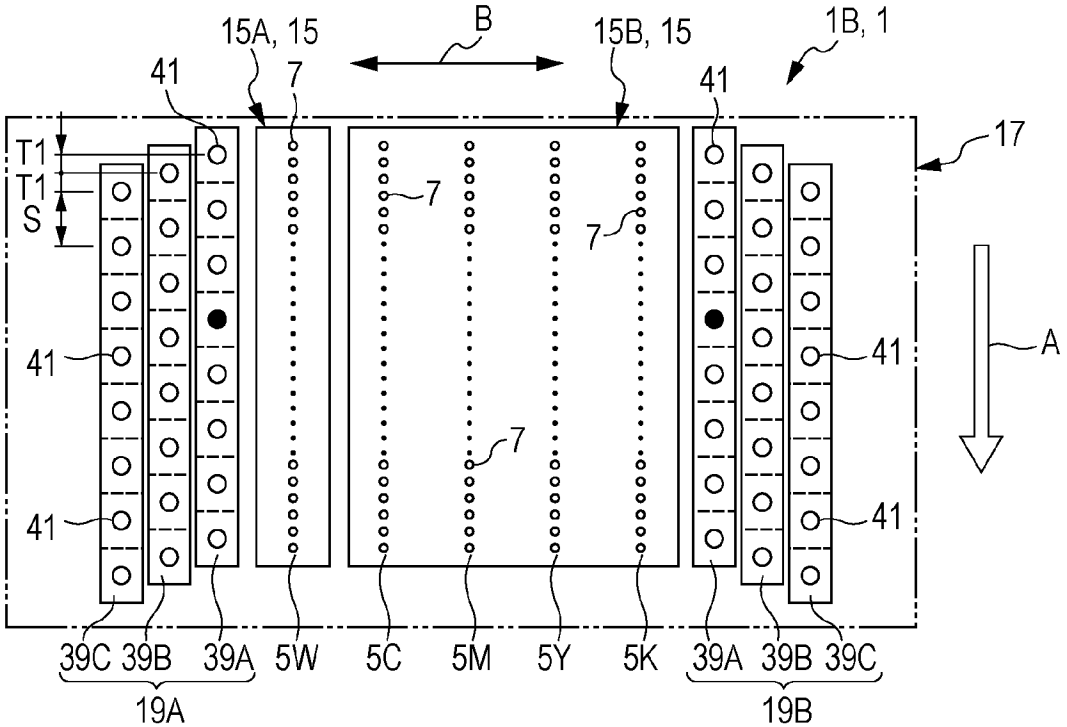
FIGS. 6A to 6C are schematic illustrations illustrating arrangements of light emitting element rows of a recording apparatus according to a second embodiment of the invention.
Figure 6B:
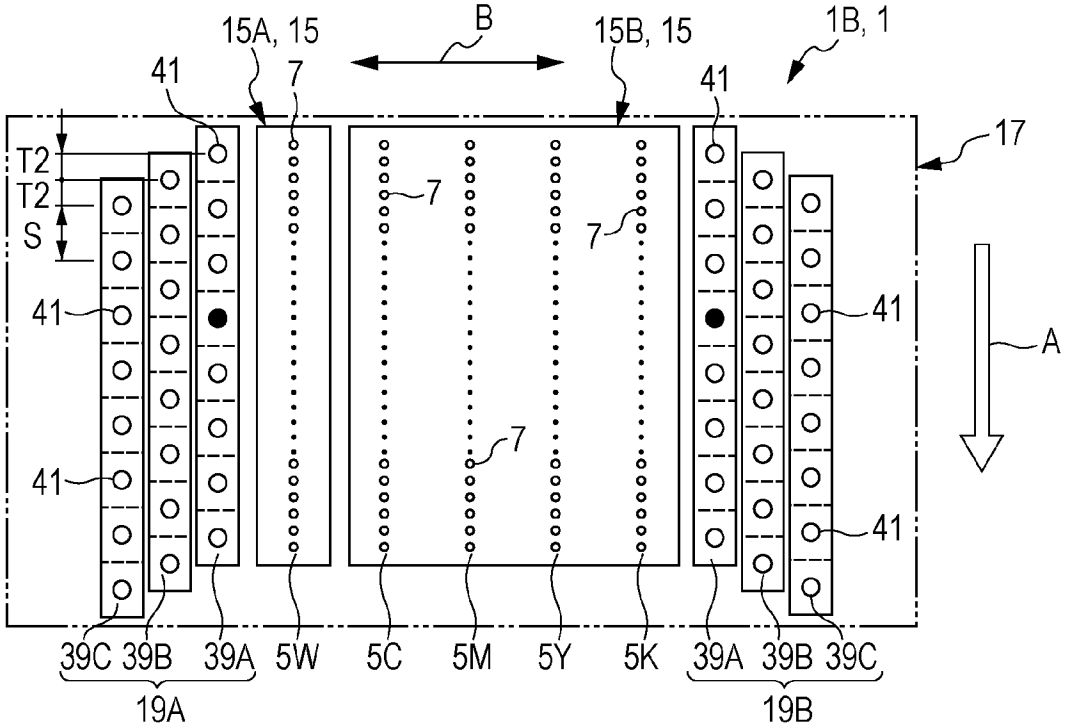
Figure 6C:
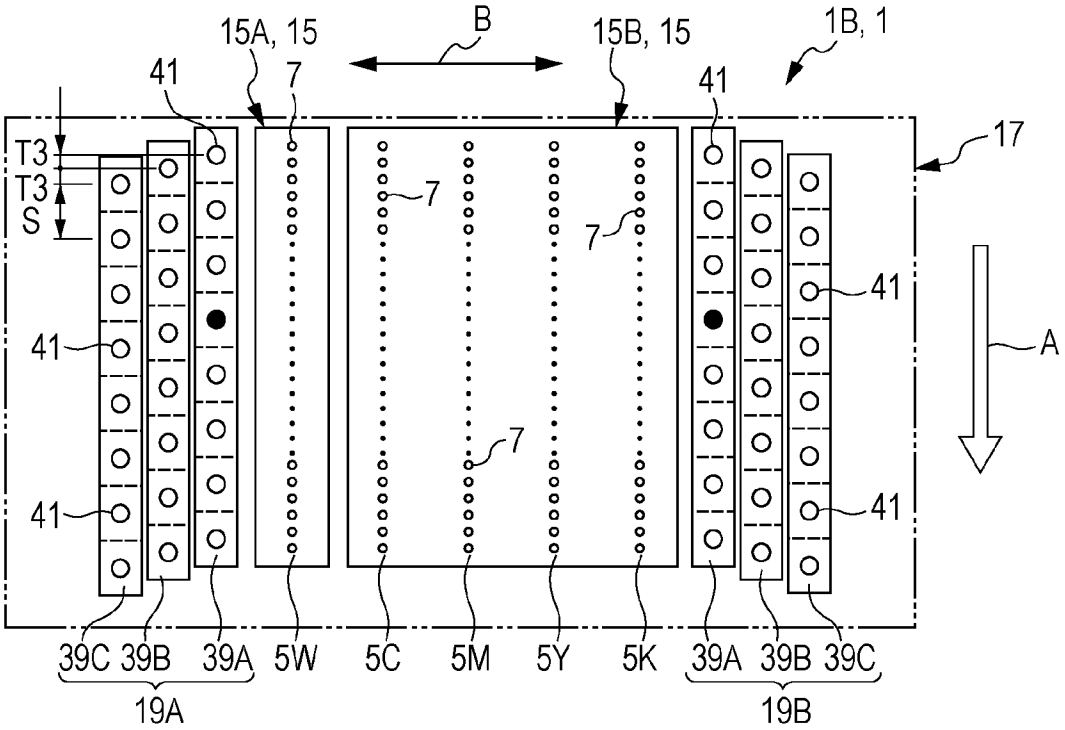

FIGS. 6A to 6C

An ink jet printer 1B according to a second embodiment has basically the same configuration as the ink jet printer 1A according to the first embodiment, and is different from the ink jet printer 1A only in that the arrangement of the LEDs 41 together forming the light emitting element row 39 differs among the light emitting element rows 39A, 39B, and 39C. That is, also in the second embodiment, the plurality of light emitting elements 41 are connected in series in each of the light emitting element rows 39A, 39B, and 39C, as illustrated in FIG. 7.

Accordingly, here, a description will focus on the arrangement of the LEDs 41 in each of the light emitting element rows 39A, 39B, and 39C, which is different from that in the first embodiment, and operation and effects of the ink jet printer 1B that are attained by adopting such an arrangement.

That is, in this embodiment, the light emitting element rows 39A, 39B, and 39C in three rows are arranged in the following manner. Each of the light emitting element rows 39A, 39B, and 39C includes the LEDs aligned at the predetermined pitch S in the transport direction A of the paper P. The LEDs 41 of each light emitting element row 39 are arranged at positions disposed in the transport direction A of the paper P. The positions are located in such a manner that the light emitting element rows 39A, 39B, and 39C are shifted with respect to each other by a predetermined pitch T.

In this regard, FIG. 6A illustrates an arrangement in which the positions disposed in the transport direction A of the LEDs 41 are located such that the light emitting element rows 39A, 39B, and 39C are shifted with respect to each other by one-third pitch T1, and FIG. 6B illustrates an arrangement in which the light emitting element rows 39A, 39B, and 39C are shifted with respect to each other by one-half pitch T2. FIG. 6C illustrates an arrangement in which the light emitting element rows 39A, 39B, and 39C are shifted with respect to each other by one-fourth pitch T3.

In the case where such an arrangement of the LEDs 41 is adopted, when an fault occurs in an LED 41 of one light emitting element row 39, a plurality of LEDs 41 close thereto in the transport direction A of other light emitting element rows 39 will make up for a shortage of the amount of light irradiation of the faulty LED 41.

Accordingly, the plurality of LEDs 41 close to the faulty LED in other light emitting element rows 39 will be responsible for a shortage of the amount of light irradiation of the faulty LED 41 in proportion to the respective amounts of their shifts. By combining together their responsibilities, the shortage of the amount of light irradiation of the faulty LED 41 is made up for.

In the second embodiment, unlike the foregoing first embodiment, the positions of the LEDs 41 in the direction of the nozzle row 5 are located in such a manner that the light emitting element rows are shifted with respect to each other by a predetermined pitch. That is, the positions of the boundaries between two adjacent LEDs 41 in the row direction are not the same in all the light emitting element rows 39A, 39B, and 39C, unlike the first embodiment, and these positions in the light emitting element rows 39A, 39B, and 39C are shifted with respect to each other. Accordingly, from a viewpoint of uniformity in the amounts of irradiation of the light applied from the LEDs 41 to the reaction liquid discharged from each nozzle opening 7, the influence of the position of the boundary mentioned above is dispersed and is less manifestly exerted, unlike the first embodiment. Thus, the effect of improving uniformity is attained.

Other Embodiments

The recording apparatus 1 according to the invention is based on having the configuration as described above. Of course, changes, omissions, and so on of partial configurations may be made without departing from the spirit and scope of the invention.

For example, the number of light emitting element rows 39 is not limited to three as adopted in the foregoing first and second embodiments. Two rows are acceptable, and four or more rows may be provided.

In the case of the ink jet printer 1 that prints only the image 13, only the second recording head 15B for image formation may be provided, and two sets of second irradiation units 19B may be arranged on right and left sides in the direction B of the second recording head 15B such that a plurality of rows are disposed on each of the right and left sides.

In this regard, in the case where such a configuration is adopted, operations of the second recording head 15B and the second irradiation unit 19B need not be switched between the on-state and the off-state depending on whether the carriage 17 moves in the outward direction or in the homeward direction. This facilitates control over these operations in the control unit 21. While a serial printer having a configuration in which a recording head reciprocally moving has been described in the foregoing embodiments, the invention is of course applicable to a line printer using a line head in which a recording head does not move.

In addition, the amounts of light irradiation of the LEDs 41 that cover a shortage of the amount of light irradiation of the faulty LED 41 may be adjusted depending on whether operation is in the normal mode 43 or in the fault mode, or in accordance with the position of the faulty LED 41. The amounts of light irradiation of the LEDs 41 may also be adjusted in accordance with the distances from the recording head 15 of the plurality of light emitting element rows 39.

The photoreactive liquid C discharged from the recording head 15 is not limited to UV curable ink. It is therefore possible to adopt various photoreactive liquids C in which a chemical change is produced by irradiation with the light E having wavelengths other than those of ultraviolet rays (UV light), and the light emitting element 41 is not limited to the LED. Specifically, the invention is applicable, for example, to the ink jet printer 1 that forms the image 13 on the recording surface 9 of the recording target material P utilizing the photoreactive liquid C that changes color by receiving irradiation of the light E of a certain wavelength.

The entire disclosure of Japanese Patent Applications No. 2011-82034, filed on Apr. 1, 2011 and No. 2011-92773, filed on Apr. 19, 2011 are expressly incorporated by reference herein.

What is claimed is:

1. A recording apparatus comprising:

a recording head having a nozzle row that discharges a photoreactive liquid onto a recording target material;

a light irradiation unit including a light emitting element row having therein a plurality of light emitting elements aligned in a same direction as the nozzle row, the light emitting elements being configured to apply light to the discharged photoreactive liquid to cause the photoreactive liquid to undergo a chemical change;

a fault detection unit that detects whether there is a fault in each of the light emitting elements forming together the light emitting element row; and a control unit that controls a recording operation of the recording head and an operation of the light irradiation unit, wherein the light irradiation unit includes a plurality of the light emitting element rows arranged therein, wherein each of the light emitting element rows includes the light emitting elements connected in series, and wherein the control unit is configured to, in a case where the fault detection unit detects a fault in a light emitting element, enter a fault mode where one of the light emitting element rows to which the light emitting element having the fault belongs is turned off and recording is performed with the remaining light emitting element rows, wherein the control unit is configured to be able to execute control:

in a case where the fault detection unit detects a fault in a light emitting element, to determine whether the fault has occurred in an open mode, if the fault has occurred in the open mode, to enter the fault mode where recording is performed with the remaining light emitting element rows, other than the light emitting element row to which the light emitting element having the fault belongs, if the fault has occurred in a short mode, to determine whether recording is possible in a case where the light emitting element row to which the light emitting element having the fault belongs is turned off, and if possible, to turn off the light emitting element row to which the light emitting element having the fault belongs and to enter the fault mode.

2. The recording apparatus according to claim 1, wherein the plurality of light emitting element rows are arranged such that each thereof includes the light emitting elements aligned at a predetermined pitch in the same direction as the direction of the nozzle row, the light emitting elements being arranged at positions disposed in the direction of the nozzle row, the positions being same in all the light emitting element rows.

3. The recording apparatus according to claim 1, wherein the plurality of light emitting element rows are arranged such that each thereof includes the light emitting elements aligned at a first predetermined pitch in the same direction as the direction of the nozzle row, the light emitting elements being arranged at positions disposed in the direction of the nozzle row, the positions being located in such a manner that the light emitting element rows are shifted with respect to each other by a second predetermined pitch.

4. The recording apparatus according to claim 1, wherein the control unit is configured to be able to set, as the fault mode, a relative velocity Vt of the recording head and the light irradiation unit with respect to the recording target material during recording to be slower than a relative velocity Vn in a normal mode without occurrence of a fault.

5. The recording apparatus according to claim 4, wherein the recording head is mounted on a carriage carrying out reciprocal movement in a direction crossing a transport direction of the recording target material, wherein the light irradiation unit is mounted on the carriage and is disposed on each of a front side and a back side in a moving direction of the recording head, and wherein the control unit is configured to, in the case where the fault detection unit detects a fault in a light emitting element, set the relative velocity Vt to be slower than the relative velocity Vn in both an outward direction and a homeward direction in the reciprocal movement.

6. The recording apparatus according to claim 4, wherein the recording head is mounted on a carriage carrying out reciprocal movement in a direction crossing a transport direction of the recording target material, wherein the light irradiation unit is mounted on the carriage and is disposed on each of a front side and a back side in a moving direction of the recording head, and wherein the control unit is configured to, in the case where the fault detection unit detects a fault in a light emitting element, set the relative velocity Vt to be slower than the relative velocity Vn only in a moving direction in which the light irradiation unit on a side to which the light emitting element having the fault belongs applies light.

7. The recording apparatus according to claim 4, wherein the control unit is configured to set the relative velocity Vt to decrease in accordance with the number of light emitting element rows to which light emitting elements having a fault belong.

8. The recording apparatus according to claim 1, wherein when it is determined that a fault has occurred in the short mode and that recording is not possible in the case where the light emitting element row to which the light emitting element having the fault belongs is turned off, the control unit, is further configured to be able to execute control:

to determine whether continuation of recording using the light emitting element row to which the light emitting element having the fault belongs is chosen, if chosen, to continue recording, and if not chosen, to finish recording.

9. A recording apparatus comprising:

a recording head having a nozzle row that discharges a photoreactive liquid onto a recording target material;

a light irradiation unit including a light emitting element row having therein a plurality of light emitting elements aligned in a same direction as the nozzle row, the light emitting elements being configured to apply light to the discharged photoreactive liquid to cause the photoreactive liquid to undergo a chemical change;

a fault detection unit that detects whether there is a fault in each of the light emitting elements forming together the light emitting element row; and a control unit that controls a recording operation of the recording head and an operation of the light irradiation unit, wherein the light irradiation unit includes a plurality of the light emitting element rows arranged therein, wherein each of the light emitting element rows includes the light emitting elements connected in series, and wherein the control unit is configured to, in a case where the fault detection unit detects a fault in a light emitting element, enter a fault mode where one of the light emitting element rows to which the light emitting element having the fault belongs is turned off and recording is performed with the remaining light emitting element rows, wherein the control unit is configured to be able to set, as the fault mode, a relative velocity Vt of the recording head and the light irradiation unit with respect to the recording target material during recording to be slower than a relative velocity Vn in a normal mode without occurrence of a fault, wherein the recording head is mounted on a carriage carrying out reciprocal movement in a direction crossing a transport direction of the recording target material, wherein the light irradiation unit is mounted on the carriage and is disposed on each of a front side and a back side in a moving direction of the recording head, and wherein the control unit is configured to, in the case where the fault detection unit detects a fault in a light emitting element, set the relative velocity Vt to be slower than the relative velocity Vn only in a moving direction in which the light irradiation unit on a side to which the light emitting element having the fault belongs applies light.

* * * * *